US007381097B2

(12) United States Patent
Ellis et al.

(10) Patent No.: US 7,381,097 B2
(45) Date of Patent: Jun. 3, 2008

(54) COMMUNICATIONS CONNECTORS WITH PARASITIC AND/OR INDUCTIVE COUPLING ELEMENTS FOR REDUCING CROSSTALK AND RELATED METHODS

(75) Inventors: Thomas Ellis, Dallas, TX (US); Derek Scarbrough, Dallas, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 241 days.

(21) Appl. No.: 11/369,457

(22) Filed: Mar. 7, 2006

(65) Prior Publication Data

US 2007/0173103 A1 Jul. 26, 2007

Related U.S. Application Data

(60) Provisional application No. 60/761,088, filed on Jan. 23, 2006.

(51) Int. Cl.
*H01R 24/00* (2006.01)

(52) U.S. Cl. ..... 439/676

(58) Field of Classification Search ..... 439/676, 439/894, 941, 344, 404
See application file for complete search history.

(56) References Cited

U.S. PATENT DOCUMENTS 4,825,162 A * 4/1989 Roemer et al. ..... 324/318
5,186,647 A * 2/1993 Denkmann et al. ..... 439/395
5,326,284 A * 7/1994 Bohbot et al. ..... 439/676
5,459,643 A 10/1995 Siemon et al.
5,460,545 A 10/1995 Siemon et al.
5,547,405 A * 8/1996 Pinney et al. ..... 439/894
5,634,817 A 6/1997 Siemon et al.
5,708,361 A * 1/1998 Wang et al. ..... 324/318
5,733,140 A 3/1998 Baker, III et al.
5,864,039 A 1/1999 Kawakita et al.
6,290,524 B1 * 9/2001 Simmel ..... 439/289
6,413,121 B1 7/2002 Hyland
6,520,808 B2 * 2/2003 Forbes et al. ..... 439/676
6,716,054 B1 4/2004 Denovich et al.
6,729,899 B2 * 5/2004 Aekins et al. ..... 439/404
2004/0002261 A1 1/2004 Pepe et al.
2004/0124840 A1 * 7/2004 Reykowski ..... 324/318
2006/0121788 A1 * 6/2006 Pharney ..... 439/676
2006/0183359 A1 8/2006 Gerber et al.
2007/0184725 A1 * 8/2007 Hashim ..... 439/676

FOREIGN PATENT DOCUMENTS

EP 0 844 697 A2 5/1998
EP 1 693 933 A1 8/2006

OTHER PUBLICATIONS

Salman Haider et al., Microstrip Patch Antennas for Broadband Indoor Wireless Systems, The University of Auckland, Depart. of Electrical & Electronics Engineering, Part 4 Project Report, 2003.

* cited by examiner

*Primary Examiner*—Chandrika Prasad
(74) *Attorney, Agent, or Firm*—Myers Bigel Sibley & Sajovec

(57) ABSTRACT

Communications connectors that include parasitic conductive loops are provided, such as a wire connection system that includes a first pair of wire connection terminals mounted in a mounting substrate, a second pair of wire connection terminals mounted in a mounting substrate and a parasitic conductive loop mounted adjacent at least the first pair of wire connection terminals.

34 Claims, 9 Drawing Sheets

COMMUNICATIONS CONNECTORS WITH PARASITIC AND/OR INDUCTIVE COUPLING ELEMENTS FOR REDUCING CROSSTALK AND RELATED METHODS

RELATED APPLICATIONS

This application claims priority from U.S. Provisional Patent Application Ser. No. 60/761,088, filed Jan. 23, 2006, entitled COMMUNICATIONS CONNECTORS WITH PARASITIC COUPLING ELEMENTS FOR REDUCING CROSSTALK AND RELATED METHODS, the disclosure of which is hereby incorporated herein by reference in its entirety.

FIELD OF THE INVENTION

The present invention relates generally to communications connectors and, more particularly, to methods and apparatus for reducing crosstalk in communications connectors.

BACKGROUND OF THE INVENTION

In an electrical communication system, it is sometimes advantageous to transmit information signals (e.g., video, audio, data) over a pair of wires (hereinafter "wire-pair" or "differential pair") rather than a single wire using balanced transmission techniques. In such systems, the transmitted information signal comprises the voltage difference between the wires without regard to the absolute voltages present. Each wire in a wire-pair is susceptible to picking up electrical noise from sources such as lightning, automobile spark plugs and radio stations to name but a few. Because this type of noise is common to both wires within a pair, the differential information signal is typically not disturbed.

Of greater concern, however, is the electrical noise that is picked up from nearby wires or pairs of wires that may extend in the same general direction for some distance. This noise is referred to as crosstalk. In a communication system involving networked computers, channels are formed by cascading connectors and cable segments. In such channels, the close channels are formed by cascading connectors and cable segments. In such channels, the close proximities and routings of the electrical wires (conductors) and the contacting structures within the connectors can produce capacitive as well as inductive couplings that generate near-end crosstalk (NEXT) (i.e., the crosstalk measured at an input location corresponding to a source at the same location) as well as far-end crosstalk (FEXT) (i.e., the crosstalk measured at the output location corresponding to a source at the input location). The crosstalk induced from the wire(s) of a first differential pair on a second closely spaced differential pair generally comprises an undesired signal that can interfere with the information signal carried by the second differential pair. As long as the same noise signal is added to each wire in the wire-pair, the voltage difference between the wires will remain about the same and differential crosstalk is not induced, while at the same time the average voltage on the two wires with respect to ground reference is elevated and common mode crosstalk is induced. On the other hand, when equal but opposite noise signals are added to each wire in the wire pair, the voltage difference between the wires will be elevated and differential crosstalk is induced, while the average voltage on the two wires with respect to ground reference is not elevated and common mode crosstalk is not induced. The term "differential to differential crosstalk" refers to a differential source signal on one pair inducing a differential noise signal on a nearby pair. The term "differential to common mode crosstalk" refers to a differential source signal on one pair inducing a common mode noise signal on a nearby pair. Uncompensated differential to differential and/or differential to common mode crosstalk can reduce the performance of communications connectors and the communications systems in which such connectors are used.

SUMMARY OF THE INVENTION

Pursuant to certain embodiments of the present invention, wire connection systems are provided that include a mounting substrate, first and second pairs of wire connection terminals that are mounted in the mounting substrate, and a parasitic conductive loop mounted adjacent a first wire connection terminal of the first pair of wire connection terminals. The wire connection system may, for example, be a 110-style wire connection block.

In these wire connection systems, a first portion of the parasitic conductive loop may be positioned to receive an induced signal from at least the first wire connection terminal of the first pair of wire connection terminals. A second portion of the parasitic conductive loop may be positioned so that the received induced signal generates a magnetic field adjacent at least one of the wire connection terminals of the second pair of wire connection terminals. This magnetic field may at least partially cancel a second magnetic field generated by a second wire connection terminal of the first pair of wire connection terminals. The parasitic conductive loop may, in certain embodiments, be mounted between the first pair and the second pair of wire connection terminals. The wire connection terminals may, for example, be insulation displacement contacts (IDCs). In embodiments that include IDCS, each of the IDCs may include slots for receiving conductors at opposite upper and lower ends thereof, and the slots of each IDC may be generally parallel and non-collinear.

In certain embodiments, the parasitic conductive loop may be configured to receive a first induced signal from the first wire connection terminal of the first pair of wire connection terminals that travels around the loop in a first direction, and to receive a second induced signal from a second wire connection terminal of the first pair of wire connection terminals that travels around the loop in the first direction. The first pair of wire connection terminals comprises a first IDC and a second IDC, and the second pair of wire connection terminals comprises a third IDC and a fourth IDC. In these embodiments, the first and third IDCs may be part of a first row of IDCs and the second and fourth IDCs may be part of a second row of IDCs, and the parasitic conductive loop may be configured to couple energy from a signal carried on the first IDC to the fourth IDC. In such embodiments the parasitic conductive loop may further be configured to couple energy from a signal carried on the second IDC to the third IDC.

In certain embodiments, a first portion of the parasitic conductive loop may be sized, shaped and positioned with respect to the first wire connection terminal of the first pair of wire connection terminals in order to induce a first crosstalk signal on the parasitic conductive loop from a signal carried by the first wire connection terminal. In these embodiments, a second portion of the parasitic conductive loop may be sized, shaped and positioned with respect to one of the wire connection terminals of the second pair of wire connection terminals in order to induce a second crosstalk signal onto the one of the wire connection terminals of the second pair of wire connection terminals from the first crosstalk signal.

In some embodiments, the first pair of wire connection terminals may be part of a first connecting block, and the second pair of wire connection terminals are part of a second wire connection block. In other embodiments, the first and second pairs of wire connection terminals may be adjacent pairs of wire connection terminals in the same connecting block.

Pursuant to further embodiments of the present invention, crosstalk reduction circuits are provided for communications connectors that include a first conductor that carries a first signal and a second conductor that carries a second signal. In these connectors the crosstalk reduction circuit comprises a parasitic conductive loop that is configured to receive a current induced from a first magnetic field generated by the first signal, where the current induced on the parasitic conductive loop generates a third magnetic field that at least partially cancels out a second magnetic field that is generated by the second signal. The third magnetic field may at least partially cancel the second magnetic field in the vicinity of a third conductor of the communications connector.

In certain embodiments, the first and second signals may be equal but opposite signals. The first and second conductors may, for example, be insulation displacement contacts (IDC). In IDC embodiments, the first IDC may have first and second conductor receiving slots that are in the same plane, but non-collinear.

In specific embodiments, a first portion of the parasitic conductive loop is adjacent the first conductor and a second portion of the parasitic conductive loop is adjacent the second conductor. In these embodiments, a portion of a third magnetic field adjacent the first portion of the parasitic conductive loop has a first direction and a portion of the third magnetic field adjacent the second portion of the parasitic conductive loop has a second direction that is substantially opposite the first direction.

In specific embodiments, the first conductor may be a first conductor of a pair of conductors of a modular plug, and the second conductor may be the second conductor of the pair of conductors. In these embodiments, the first and second signals may be equal magnitude but opposite polarity signals.

Pursuant to still additional embodiments of the present invention, communications connectors are provided that include a parasitic coupling element, a first conductor adjacent a first portion of the parasitic coupling element and a second conductor adjacent a second portion of the parasitic coupling element. In these connectors, the parasitic coupling element is configured to couple a compensating crosstalk signal that is induced from the first conductor to the second conductor, where the coupled compensating crosstalk signal is induced on the second conductor in a direction opposite the direction of a signal from which the crosstalk signal was generated. The parasitic coupling element may comprise a loop, and the first portion of the parasitic coupling element may be on a first part of the loop and the second portion of the parasitic coupling element may be on a second portion of the loop that is generally opposite the first part of the loop.

Pursuant to still further embodiments of the present invention, communications connectors are provided that include a first contact and a second contact that are configured to receive a first differential signal, a third contact and a fourth contact that are configured to receive a second differential signal, and a parasitic coupling element positioned between the first and second contacts and the third and fourth contacts, where the parasitic coupling element is configured to receive a first induced signal from the first contact that has a first polarity and to receive a second induced signal from the second contact that has the first polarity.

Pursuant to yet additional embodiments of the present invention, methods for reducing a differential crosstalk signal induced from a first pair of conductors that comprises a first conductor and a second conductor onto a third conductor of a communications connector are provided. Pursuant to these methods, a crosstalk signal is induced from a signal flowing through the first conductor onto a first portion of a parasitic conductive loop so as to generate a first magnetic field around a second portion of the parasitic conductive loop that at least partially cancels a second magnetic field generated by a signal flowing through the second conductor. The first and second magnetic fields may at least partially cancel each other adjacent the third conductor.

Pursuant to still further embodiments of the present invention, wire connection blocks are provided that include first and second wire connection terminals that define a first row of wire connection terminals and third and fourth wire connection terminals that define a second row of wire connection terminals that is generally parallel to the first row of wire connection terminals. The wire connection blocks further include an inductive coupling element that is positioned to inductively couple energy from a signal transmitted on the first wire connection terminal to the fourth wire connection terminal. In some embodiments, the inductive coupling element may be a parasitic conductive loop. In other embodiments, the inductive coupling element may be a signal carrying protrusion on the first wire connection terminal.

DETAILED DESCRIPTION

Figure 1:
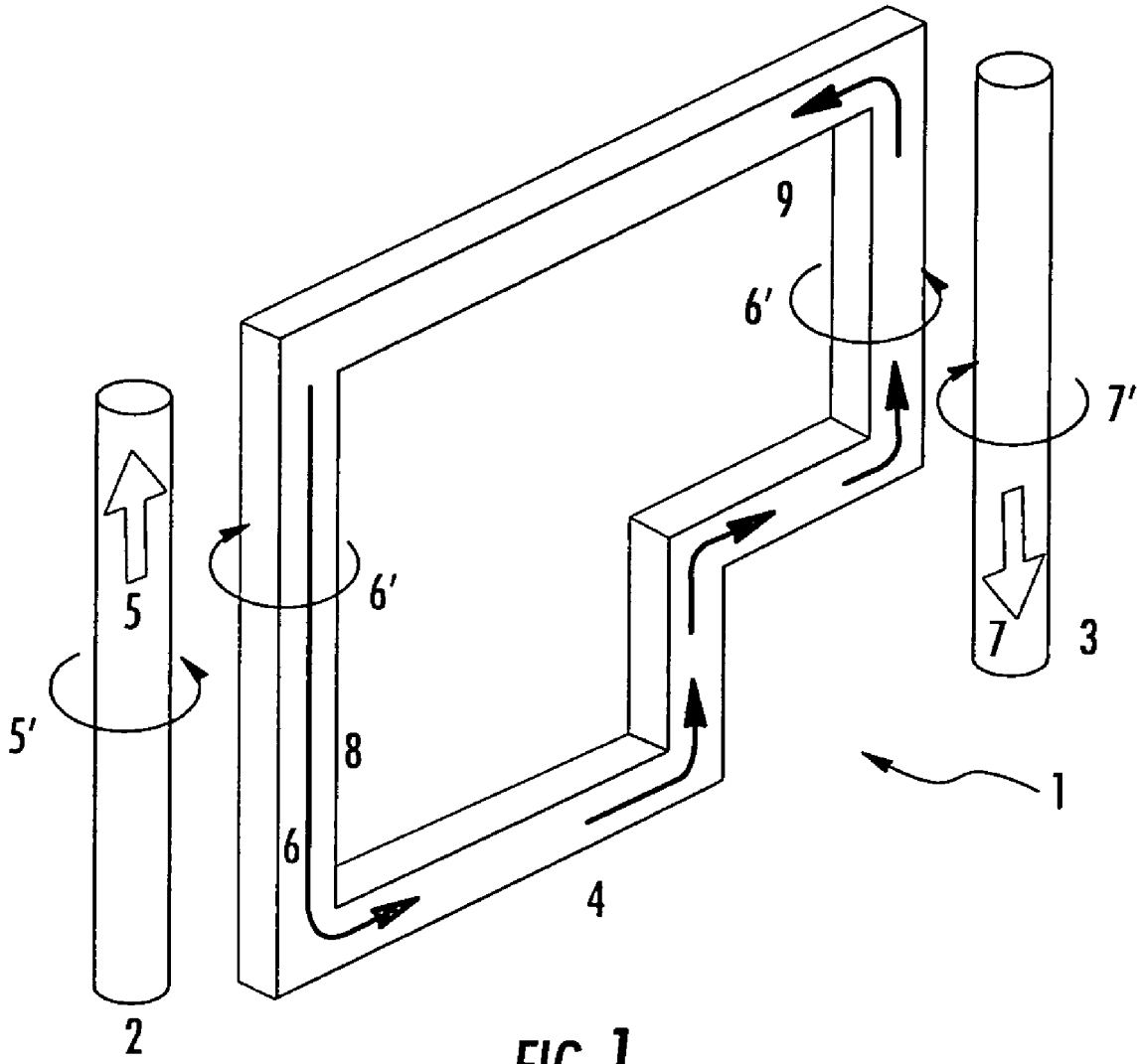
FIG. 1 is a perspective view of a parasitic coupling element interacting with first and second conductors according to embodiments of the present invention.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including," when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Where used, the terms "attached", "connected", "interconnected", "contacting", "mounted" and the like can mean either direct or indirect attachment or contact between elements, unless stated otherwise.

Pursuant to embodiments of the present invention, communications connectors are provided which include one or more "parasitic conductive loops" that are used to alter the inductive and/or capacitive coupling between targeted conductors within the communications connector. The communications connectors according to embodiments of the present invention may exhibit reduced levels of differential to differential and/or differential to common mode crosstalk between conductors thereof.

As used herein, the term "conductive loop" refers to a conductive element that forms a closed or endless path through which current can flow. As the conductive loop is a closed path, an electrical signal that is introduced onto a portion of the conductive loop can travel around the loop to return to the location where it was introduced onto the loop. The term "loop" refers to the fact that the loop defines a closed path, and does not limit the invention to loops having any particular 2-dimensional or 3-dimensional shapes. For example, the conductive loops according to embodiments of the present invention can be circular, oval, rectangular, parallelogramatic, rhomboid, etc. or combinations of such shapes. The conductive loops may also be three-dimensional in nature, and/or may include more than one closed path. By way of example, a conductive loop could be implemented on a printed circuit board to have a rectangular shape when viewed from above by providing (1) a first L-shaped trace implemented on a first layer of the printed circuit board, (2) a second L-shaped trace implemented on a second layer of the printed circuit board, and (3) a pair of metal plated holes that connect the two traces.

As used herein, a "parasitic" element (also referred to as a "parasitic coupling element") refers to an element that is not directly electrically connected to one or more second elements, but which is positioned so as to receive a crosstalk signal from the one or more second elements via capacitive and/or inductive coupling. Thus, a "parasitic conductive loop" refers to a closed-loop conductive path that is positioned near, but not in physical contact with, one or more second elements, such that a crosstalk signal is inductively and/or capacitively coupled from the one or more second elements onto the closed-loop conductive path.

FIG. 1 depicts a communications system 1 in which a parasitic conductive loop 4 interacts with two conductors 2, 3 according to embodiments of the present invention. As shown in FIG. 1, the communications system 1 includes at least two conductors 2, 3 which, in the embodiment of FIG. 1, are depicted as wires. It will be appreciated, however, that embodiments of the present invention may be employed along any different part of the communications path such as, for example, printed circuit boards, wire connection terminals, plug blades, jackwire contacts, etc., and thus the wire conductors 2, 3 depicted in FIG. 1 are simply provided as one example of a type of conductor that may interact with a parasitic conductive loop according to embodiments of the present invention.

As shown in FIG. 1, the parasitic conductive loop 4 is positioned near the conductors 2, 3. In the example communications system 1 of FIG. 1, the conductors 2, 3 comprise the two wires of a differential pair. Thus, equal but opposite signals are simultaneously transmitted over wires 2, 3. This is reflected in FIG. 1 by the arrows 5 and 7 which represent the current flowing in wires 2 and 3, respectively, with each arrow indicating the direction of current flow. As shown in FIG. 1, the current 5 generates a magnetic field 5' that circles around conductor 2 in a counterclockwise direction (as viewed from above in FIG. 1). Due to the close proximity between the left portion 8 of the parasitic conductive loop 4 and the conductor 2, the magnetic field 5' will induce a current 6 (which is shown as an arrow in FIG. 1) onto the parasitic conductive loop 4. This induced current 6 will flow in a direction opposite to the direction of the current 5, and thus, as shown in FIG. 1, the magnetic field 6' generated by the current 6 circles loop portion 8 in a clockwise direction.

As the parasitic conductive loop 4 is a closed path, the current 6 that is induced on the loop 4 will tend to flow around the loop 4. As the direction of the loop 4 changes at various points, the magnetic field 6' that is generated by the current 6 also changes directions. Thus, for example, as shown in FIG. 1, on the right portion 9 of the parasitic conductive loop 4 the magnetic field 6' circles loop portion 9 in a counterclockwise direction.

As shown in FIG. 1, the magnetic field 6' extends in the counterclockwise direction around the right portion 9 of loop 4, while the magnetic field 7' generated by the current 7 flowing in conductor 3 extends in the clockwise direction. As such, the magnetic field 6' will tend to cancel at least a portion of the magnetic field 7' in the vicinity of conductor 3. The partial cancellation of the magnetic field 7' will reduce the ability of the current 7 flowing through conductor 3 to induce currents on other nearby conductors (not shown in FIG. 1) in the communications system 1. Thus, as shown in FIG. 1, by generating canceling magnetic fields, parasitic conductive loops according to embodiments of the present invention may be used to reduce crosstalk in communications systems. It will likewise be appreciated that parasitic conductive loops may also be provided to cancel electric fields, and that the concepts discussed herein with respect to exemplary embodiments of the present invention may likewise be configured to provide such electric field cancellation. It will further be appreciated that a single parasitic conductive loop may be used to provide both magnetic and electric field cancellation.

Communications connectors according to further embodiments of the present invention will now be described with respect to FIGS. 2-9. In FIGS. 2-9, concepts according to embodiments of the present invention are implemented in a 110-style cross-connect wiring system. It will be appreciated, however, that embodiments of the present invention encompass numerous additional types of connection systems including, for example, modular plugs, modular jacks, non-110 style wire connecting blocks, etc.

Figure 2:
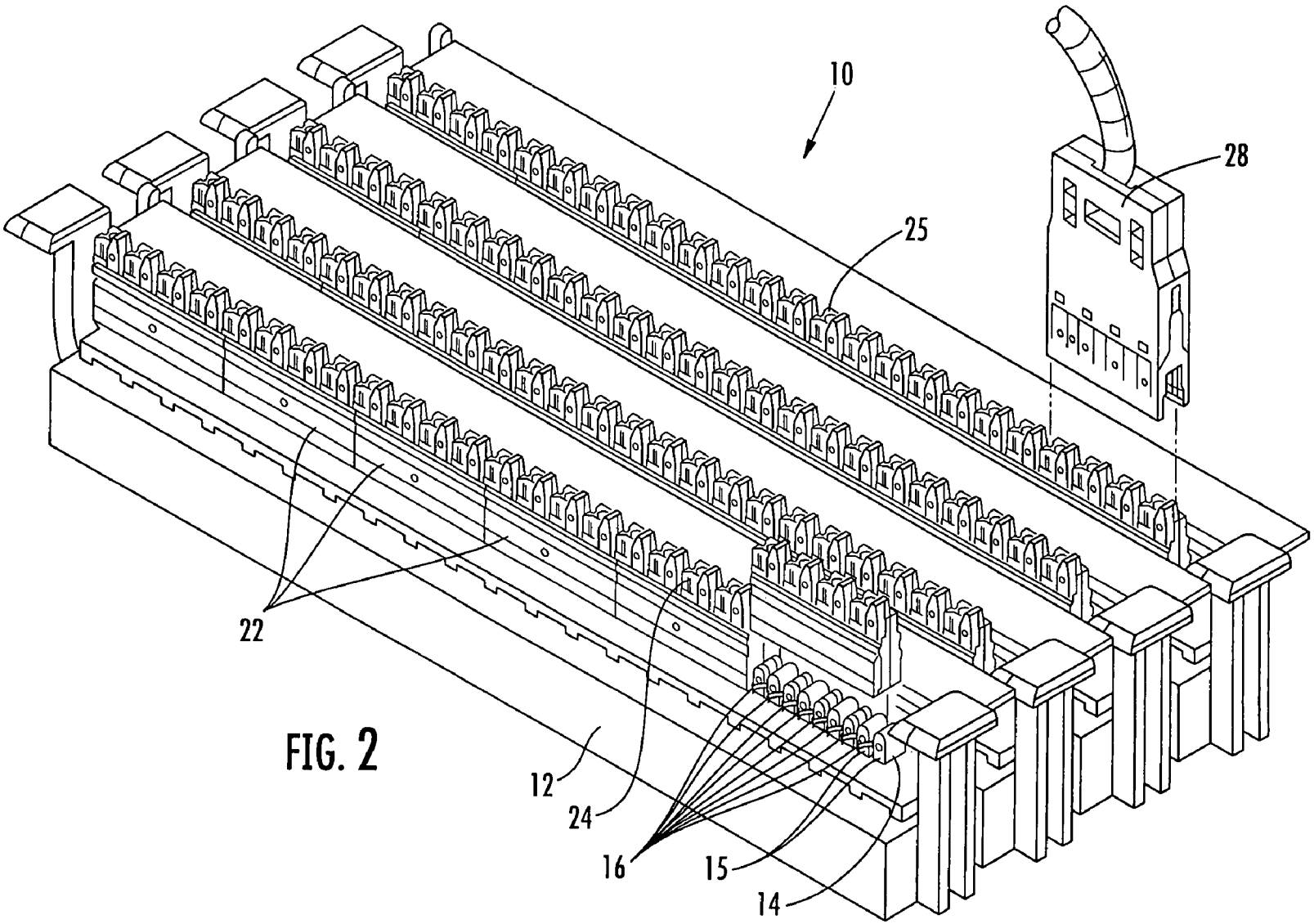
FIG. 2 is an exploded perspective view of a 110-style data communications system in which communications connectors according to embodiments of the present invention may be used.

FIG. 2 depicts a 110-style cross-connect communications system 10, which is a well-known type of communications system that is often used in wiring closets that terminate a large number of incoming and outgoing wiring systems. The communications system 10 comprises field-wired cable termination apparatus that is used to organize and administer cable and wiring installations. The communications system 10 would most typically be located in the equipment room and provides termination and cross-connection of network interface equipment, switching equipment, processor equipment, and backbone (riser or campus) wiring. The cross-connect communications system 10 is typically located in a telecommunications closet and provides termination and cross-connection of horizontal (to the work area) and backbone wiring. Cross-connects can provide efficient and convenient routing and rerouting of common equipment circuits to various parts of a building or campus.

As shown in FIG. 2, the communications system 10 has connector ports 15 arranged in horizontal rows. Each row of connector ports 15 comprises a conductor seating array 14 that is commonly referred to as an "index strip." Conductors (i.e., wires) 16 are placed between the connector ports 15. As shown in FIG. 2, once the conductors 16 are in place, connecting blocks 22 are placed over the index strips 14 and make electrical connections to the conductors 16. Each connecting block 22 may include a plurality of double-ended slotted beam insulation displacement contacts (IDCs), which generally are not visible in FIG. 2. One end of each IDC forms an electrical contact with a respective one of the conductors 16 mounted in the index strip 14. The other end of each IDC makes an electrical connection with a cross-connect wire (not shown), or with a contact of a patch cord 28 that is terminated in ports 25 that are defined by the IDCs 24 on the top of the connecting blocks 22. FIG. 2 shows four horizontal rows of six connecting blocks 22 each that are mounted on top of four index strips 14 (only a portion of one of the index strips 14 is visible in FIG. 2) in a typical terminal block 12. The spaces between the index strips 14 become troughs, typically for cable or cross-connect wire routing. The conductors 16 are routed through the cable troughs and other cabling organizing structure to their appropriate termination ports in the index strips 14.

Figure 3:
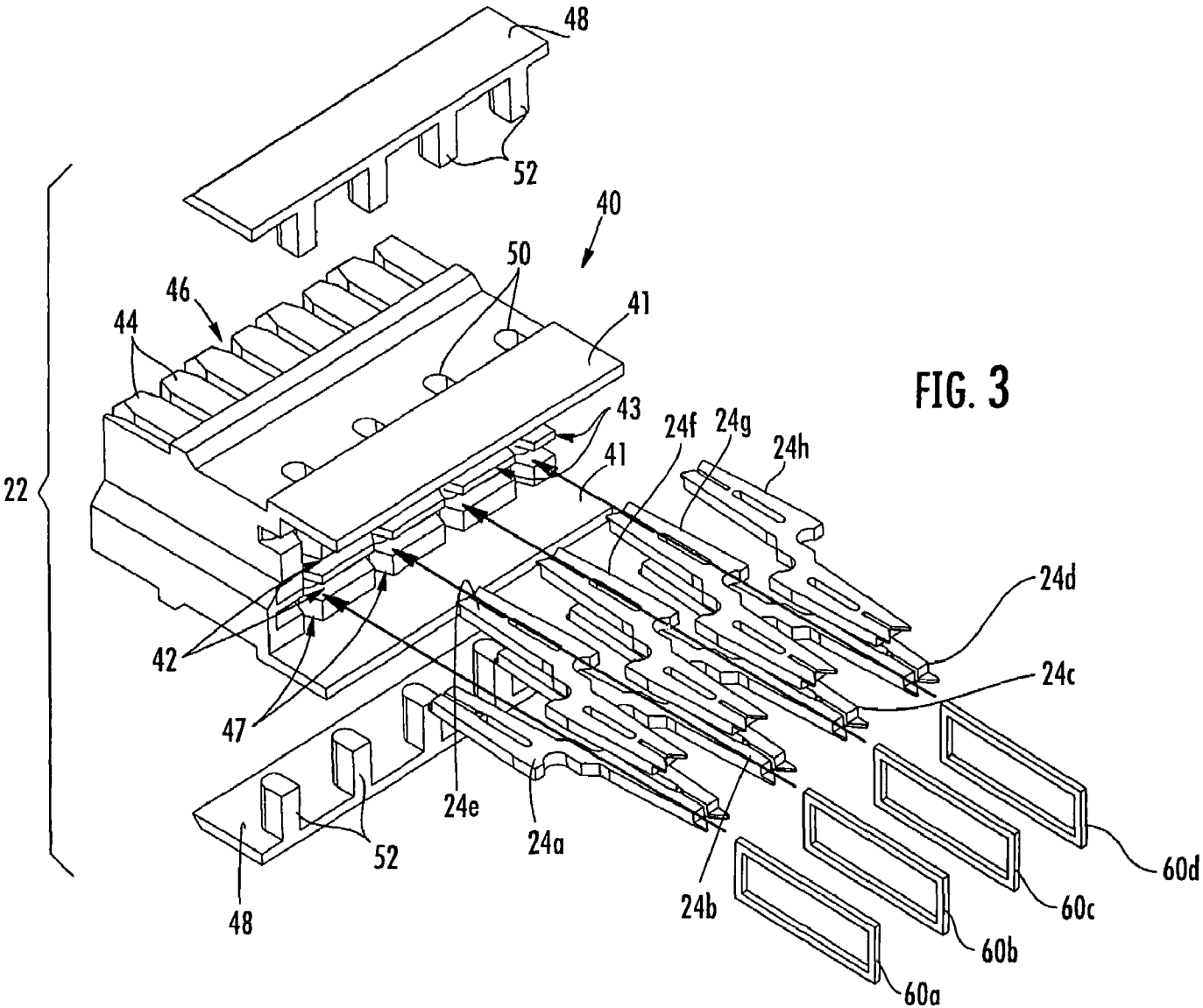
FIG. 3 is an exploded perspective view of a connecting block employed in the data communication system illustrated in FIG. 2.

As shown in FIG. 3, an exemplary connecting block 22 may include a main housing 40, two locking members 48, eight IDCs **24*a*-24*h* and four parasitic conductive loops 60*a*-60*d*. These components are described below with respect to FIGS. 4-6**.

Figure 5:
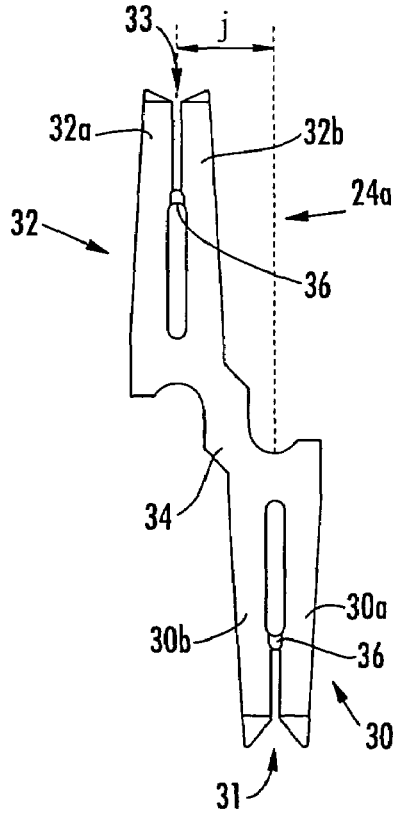
FIG. 5 is an enlarged front view of an exemplary IDC of the connecting block of FIG. 3.

FIG. 5 illustrates an exemplary IDC, IDC **24*a*, of the connecting block 22. IDCs are a known type of wire connection terminal. In general, a wire connection terminal refers to an electrical contact that receives a wire or a plug blade (or some other type of electrical contact at one end thereof (or at both ends in the case of a double-slotted IDC). The IDC 24*a* is generally planar and formed of a conductive material, such as, for example, a phosphor bronze alloy. The IDC 24*a* includes a lower end 30 with prongs 30*a*, 30*b* that define an open-ended slot 31 for receiving a mating conductor, an upper end 32 with prongs 32*a*, 32*b* that define an open-ended slot 33 for receiving another mating conductor, and a transitional area 34. Each of the slots 31, 33 may be interrupted by a small brace 36 that provides rigidity to the prongs of the IDC 24*a* during manufacturing, but which splits during "punch-down" of conductors into the slots 31, 33. The lower and upper ends 30, 32 are offset from each other such that the slots 31, 33 are generally parallel and non-collinear. The offset distance "j" between the slots 31, 33 in the lower and upper ends 30, 32** may, for example, be between about 0.080 and 0.150 inches. As discussed herein, in one particular embodiment, the distance "j" may be 0.096 inches.

Figure 4:
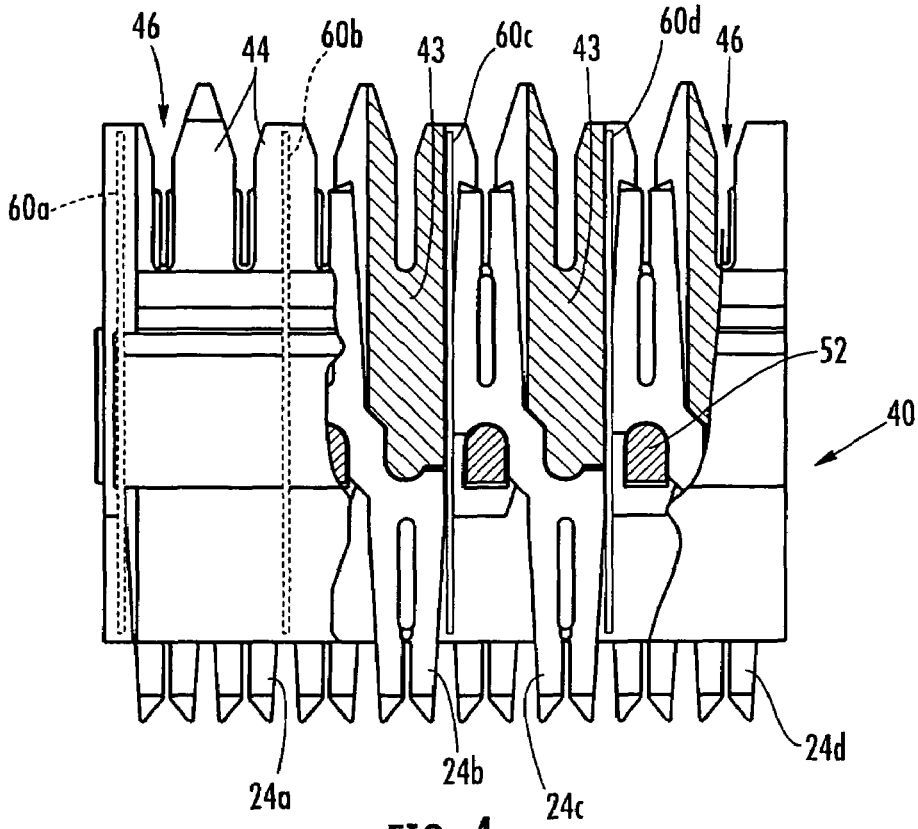
FIG. 4 is a front partial section view of the connecting block of FIG. 3.

Referring now to FIGS. 3 and 4, the main housing 40, which may, for example, be formed of a dielectric material such as polycarbonate, has flanges 41 which may serve to align the connecting block over the index strip 14 with which it mates. The main housing 40 includes through slots 42 separated by dividers 43, each of the slots 42 being sized to receive the upper end 32 of an IDC **24*a*-24*h*. The main housing 40 further includes slots 47, which are between and normal to the slots 42. The slots 47 are each sized and configured to receive one of the parasitic conductive loops 60*a*-60*d*. The upper end of the main housing 40 has multiple pillars 44 that are split by slits 46. The slits 46 expose the inner edges of the open-ended slots 33 of the IDC upper ends 32. The main housing 40 also includes apertures 50 on each side. As shown in FIG. 3, the locking members 48 are mounted to the sides of the main housing 40. The locking members 48 include locking projections 52 that are received in the apertures 50 in the main housing 40**.

As is illustrated in FIG. 3, the connecting block 22 can be assembled as follows. The IDCs **24*a*-24*h* are inserted into the slots 42 in the main housing 40 from the lower end thereof. The upper ends 32 of the IDCs 24*a*-24*h* fit within the slots 42, with the slots 33 of the upper ends 32 of the IDCs 24*a*-24*h* being exposed by the slits 46 in the main housing 40. The parasitic conductive loops 60*a*-60*d* are inserted into corresponding ones of the slots 47 in the main housing 40 from the lower end thereof. The upper ends of the parasitic conductive loops 60*a*-60*d* may extend into respective ones of the pillars 44 at the upper end of the main housing 40. Once the IDCs 24*a*-24*h* and the parasitic conductive loops 60*a*-60*d* are in place, the locking members 48 are inserted into the apertures 50 and then secured via ultrasonic welding, adhesive bonding, snap-fit latching, or some other suitable attachment technique. A locking mechanism (not shown in FIGS. 3-5) may also be provided that holds the parasitic conductive loops 60***a*-60*d* in place.

Figure 6:
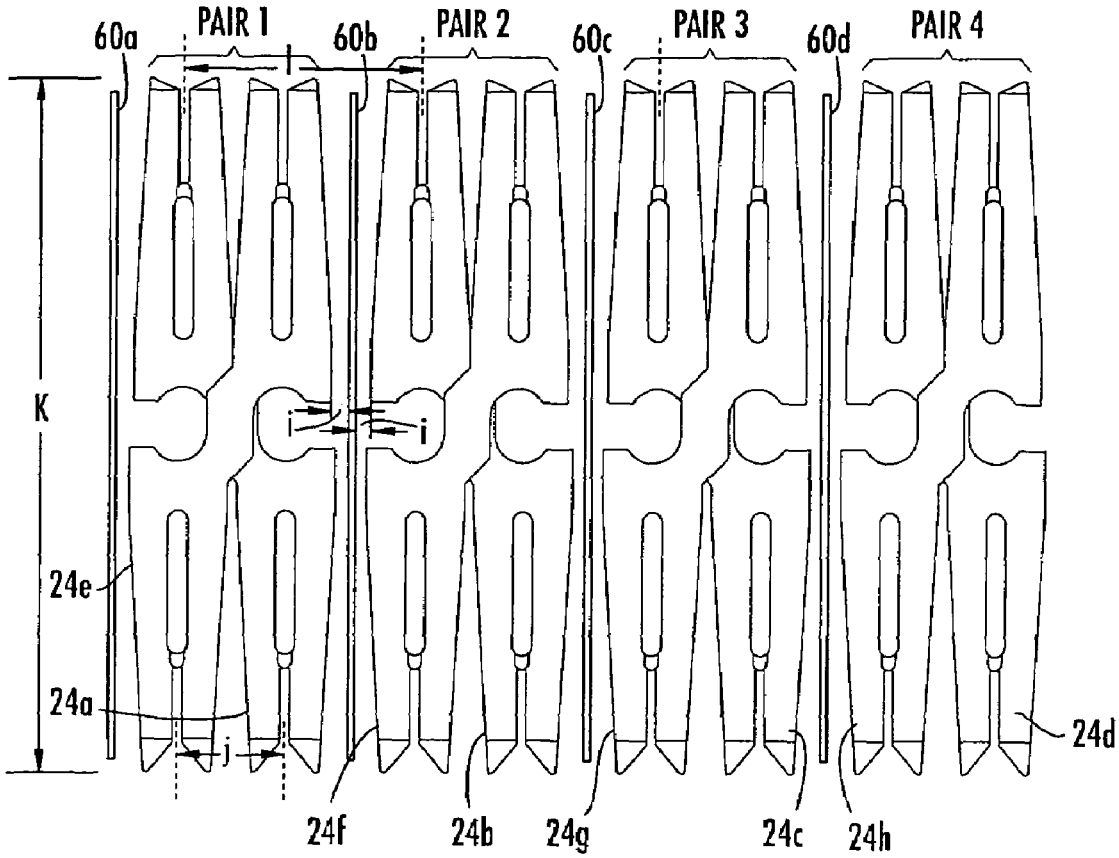
FIG. 6 is a front view of the arrangement of IDCs and parasitic conductive loops in the connecting block of FIG. 3.

As can be seen in FIGS. 4 and 6, once in the main housing 40, the IDCs 24*a*-24*h* are arranged in two substantially planar rows, with IDCs 24*a*-24*d* in one row and IDCs 24*e*-24*h* in a second row. Because of the "jogs" in the IDCs (i.e., the offset between the upper and lower ends 32, 30 of the IDCs), the upper ends 32 of the IDCs 24*a*-24*d* in the back row are staggered from the upper ends 32 of the IDCs 24*e*-24*h* in the front row. Likewise, because of the "jogs" in the IDCs, the lower ends 30 of the IDCs 24*a*-24*d* are staggered from the lower ends 30 of the IDCs 24*e*-24*h*. In the embodiment of connecting block 22 shown in FIGS. 3-4 and 6, the transitional area 34 of the IDCs in opposing rows are aligned (e.g., the transition area 34 of IDC 24*a* is directly across from the transition area 34 of IDC 24*e*). In other embodiments, the transition areas 34 of opposing IDCs may be staggered.

As is also shown in FIG. 6, the IDCs 24*a*-24*h* can be divided into TIP-RING IDC pairs as set forth in Table 1 below, where by convention, the TIP is the positively polarized terminal and the RING is the negatively polarized terminal. Each of the RINGS of the IDC pairs are in one row, and each of the TIPS of the IDC pairs are in the other row.

TABLE 1

| IDC | Pair # | Type |
|---|---|---|
| 24a | 1 | TIP |
| 24b | 2 | TIP |
| 24c | 3 | TIP |
| 24d | 4 | TIP |
| 24e | 1 | RING |
| 24f | 2 | RING |
| 24g | 3 | RING |
| 24h | 4 | RING |

As also shown in FIG. 6, the length of each IDC 24*a*-24*h* may be a distance "k." In an exemplary embodiment of the present invention, "k" may be about 800 mils. In the exemplary embodiment shown in FIG. 6, the distance "j" between adjacent slots of the IDCs of an IDC pair may be about 96 mils. In the exemplary embodiment shown in FIG. 6, the distance "I" between the slots of adjacent IDCs in a row of IDCs may be about 260 mils. The parasitic conductive loops 60*a*-60*d* are also depicted in FIG. 6. As shown, the distance "i" between an edge of an IDC pair and the center of the corresponding parasitic conductive loop 60*a*-60*d* may be about 30 mils in the exemplary embodiment of FIG. 6. The first and second rows of IDCs may be separated by about 70 mils.

Figure 7:
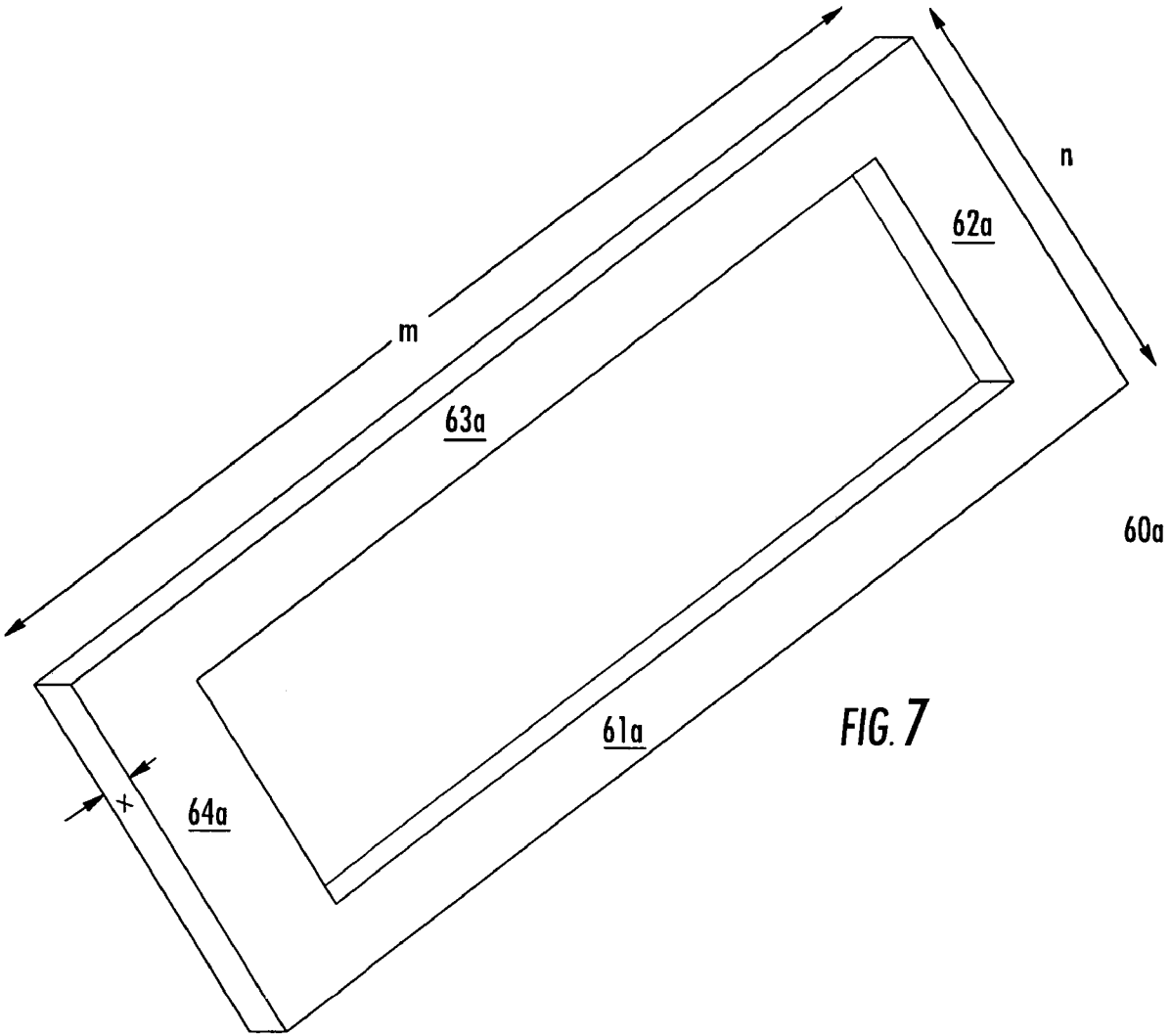
FIG. 7 is a perspective view of a parasitic conductive loop used in the connecting block of FIG. 3.

The parasitic conductive loop 60*a* of FIG. 3 is depicted in FIG. 7. As shown in FIG. 7, the parasitic conductive loop 60*a* has a right loop portion 61*a*, a left loop portion 63*a*, a top loop portion 62*a* and a bottom loop portion 64*a*. As discussed in more detail herein, pursuant to embodiments of the present invention, signal energy may be coupled from one or more of the IDCs 24*a*, 24*b*, 24*e*, 24*f* onto the parasitic conductive loop 60*a* (see FIG. 3). The signal energy coupled from one of the IDCs 24*a*, 24*b*, 24*e*, 24*f* onto the parasitic conductive loop 60*a* will then tend to travel around the loop 60*a*.

In the embodiment of FIGS. 2-9, parasitic rings 60*a*-60*d* may each have an identical shape and construction. In an exemplary embodiment, the length "m" of the right and left loop portions 61*a*, 63*a* is about 730 mils, and the length "n" of the top and bottom loop portions 62*a*, 64*a* is about 140 mils. The loop 60*a* may be formed of, for example, any material that may be considered a "good" conductor relative to the operating frequency such as copper, stainless steel, etc., and may be, for example, have a thickness "x" of 5 mils. The inner opening of the loop 60*a* may be about 650 mils by about 60 mils. It will be appreciated that the following dimensions are exemplary, and are provided so that this disclosure will be thorough and complete. It will be appreciated that loops 60*a* of numerous different shapes, dimensions, etc., may be used instead of the exemplary loop 60*a* depicted in FIG. 7.

Figure 8:
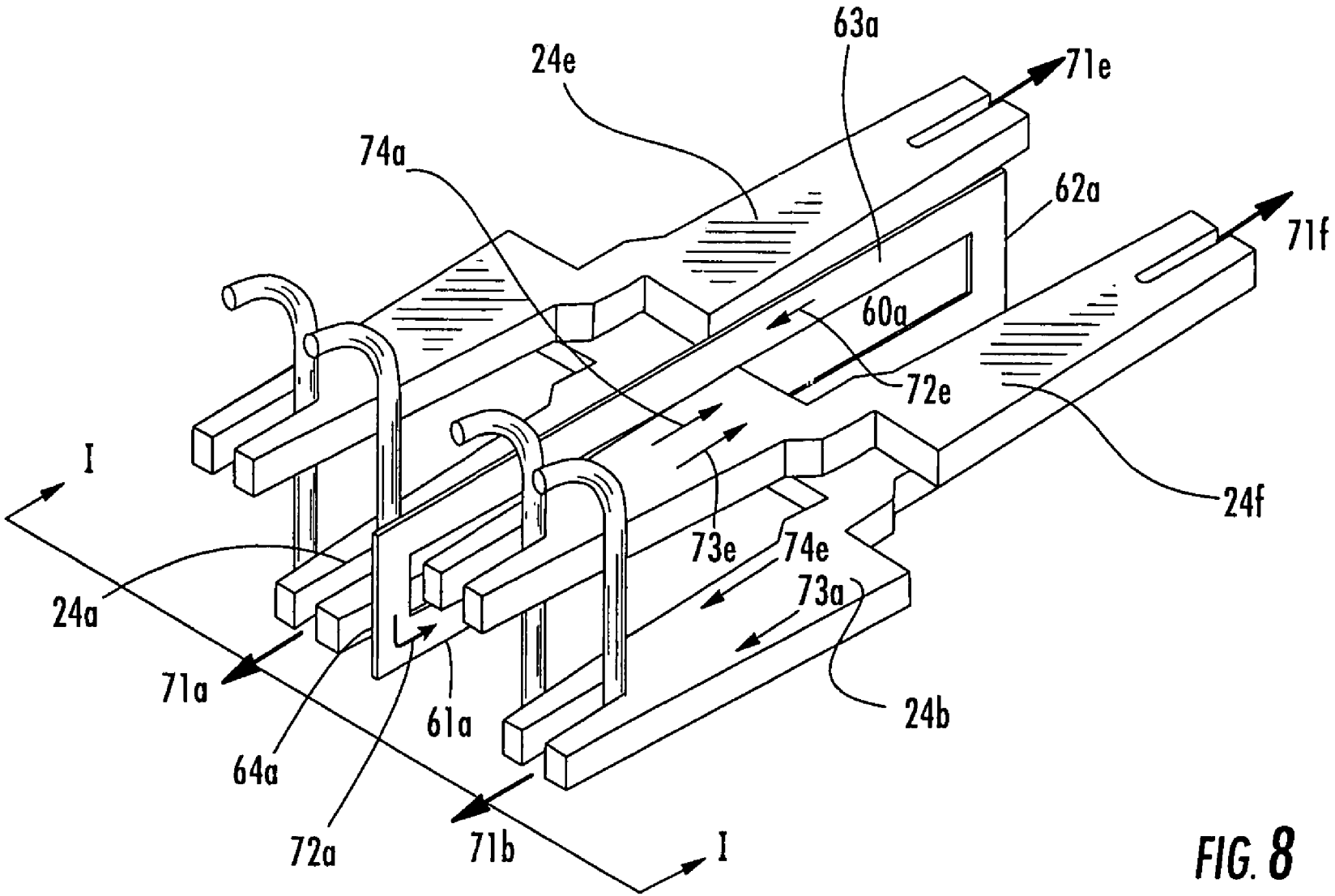
FIG. 8 is a perspective view of the arrangement of four IDCs and a parasitic conductive loop from the connecting block of FIG. 3.

FIG. 8 is a perspective view of the IDCs 24*a*, 24*e*, 24*b*, 24*f* corresponding to pairs 1 and 2, and the parasitic conductive loop 60*a* provided therebetween, as they would reside in the main housing 40 of the connecting block 22 of FIG. 3. In FIG. 8, the main housing 40 is omitted to more clearly illustrate the arrangement of the parasitic conductive loop 60*a* with respect to the IDCs. As shown in FIG. 8, the upper end of IDC 24*e* is positioned closely adjacent to the upper end of the left loop portion 63*a*, while the lower end of EDC 24*e* jogs away from the left loop portion 63*a*. Similarly, the lower end of IDC 24*f* is positioned closely adjacent to the lower end of the left loop portion 63*a*, while the upper end of IDC 24*f* jogs away from the left loop portion 63*a*. Likewise, the upper end of IDC 24*b* is positioned closely adjacent to the upper end of the right loop portion 61*a*, while the lower end of IDC 24*b* jogs away from the right loop portion 61*a*. Finally, the lower end of DC 24*a* is positioned closely adjacent to the lower end of the right loop portion 61*a*, while the upper end of IDC 24*a* jogs away from the right loop portion 61*a*. As a result, the primary coupling between the IDCs 24*a*, 24*b*, 24*e*, 24*f* and the parasitic conductive loop 60*a* will comprise coupling from the upper end of IDC 24*e* onto the upper end of the left loop portion 63*a*, coupling from the lower end of IDC 24*f* onto the lower end of the left loop portion 63*a*, coupling from the upper end of IDC 24*b* onto the upper end of the right loop portion 61*a*, and coupling from the lower end of IDC 24*a* onto the lower end of the right loop portion 61*a*.

The operation of the parasitic conductive loop 60*a* will now be described with respect to FIG. 8. As noted above, IDCs 24*a* and 24*e* comprise a pair of IDCs that are used to transmit a first differential signal. Accordingly, IDCs 24*a* and 24*e* carry equal but opposite signals. The same is true with respect to IDCs 24*b* and 24*f*. In FIG. 8, the primary signals (i.e., the desired signals) that are transmitted through IDCs 24*a*, 24*b*, 24*e* and 24*f* are shown by bold arrows 71*a*, 71*b*, 71*e* and 71*f*, respectively, with the arrow indicating the direction of travel of the signal. Thus, in the example of FIG. 8, a signal 71*a* travels down and to the left through IDC 24*a*, a signal 71*b* travels down and to the left through IDC 24*b*, a signal 71*e* travels up and to the right through IDC 24*e*, and a signal 71*f* travels up and to the right through IDC 24*f*.

As also shown in FIG. 8, due to the proximity between the upper end of IDC 24*e* and the upper end of the left loop portion 63*a*, the signal 71*e* induces a signal 72*e* on the upper end of the left loop portion 63*a*. The induced signal 72*e* travels in a direction opposite the direction of travel of signal 71*e*; hence the arrow designating signal 72*e* points down the left loop portion 63*a* towards the bottom loop portion 64*a*. Thus, after being induced onto the upper end of the left loop portion 63*a*, the signal 72*e* travels through the lower end of the left loop portion 63*a* where the signal 72*e* travels in close proximity to the lower end of IDC 24*f*. Due to this close proximity, the signal 72*e* induces a signal 73*e* on the lower end 30 of IDC 24*f*. The induced signal 73*e* travels in a direction opposite the direction of travel of signal 72*e*; hence the arrow designating signal 73*e* points up IDC 24*f*.

As is further shown in FIG. 8, the signal 72*e* continues to travel around the loop 60*a* in the direction of the arrow (i.e., in a counter-clockwise direction). After passing through the bottom loop portion 64*a*, the signal 72*e* travels up the right loop portion 61*a*. About halfway up the right loop portion 61*a*, the signal 72*e* passes in close proximity to the upper end of IDC 24*b* and, as a result, the signal 72*e* induces a signal 74*e* on the upper end 32 of IDC 24*b*. The induced signal 74*e* travels in a direction opposite the direction of travel of signal 72*e*; hence the arrow designating signal 74*e* points down the IDC 24*b*. The signal 72*e* that remains on the loop 60*a* continues to travel around the loop 60*a* in a counter-clockwise direction.

Similar to IDC 24*e*, IDC 24*a* also induces a current onto the parasitic conductive loop 60*a*. In particular, due to the proximity between the lower end of IDC 24*a* and the lower end of the right loop portion 61*a*, the signal 71*a* that is traveling down the IDC 24*a* induces a signal 72*a* on the lower end of the right loop portion 61*a*. The induced signal 72*a* travels in a direction opposite the direction of travel of signal 71*a*; hence the arrow designating signal 72*a* points up the right loop portion 61*a* towards the top loop portion 62*a*. Thus, after being induced onto the lower end of the right loop portion 61*a*, the signal 72*a* travels through the upper end of the right loop portion 61*a* where the signal 72*a* travels in close proximity to the upper end 32 of IDC 24*b*. Due to this close proximity, the signal 72*a* induces a signal 73*a* on the upper end 32 of IDC 24*b*. The induced signal 73*a* travels in a direction opposite the direction of travel of signal 72*a*; hence the arrow designating signal 73*a* points down the IDC 24*b*.

As is further shown in FIG. 8, the signal 72*a* continues to travel around the loop 60*a* in the direction of the arrow (i.e., in a counter-clockwise direction). After passing through the top loop portion 62*a*, the signal 72*a* travels down the left loop portion 63*a*. About halfway down the left loop portion 63*a*, the signal 72*a* passes in close proximity to the lower end of IDC 24*f* and, as a result, the signal 72*a* induces a signal 74a on the lower end of IDC 24*f*. The induced signal 74*a* travels in a direction opposite the direction of travel of signal 72*a*; hence the arrow designating signal 74*a* points up the IDC 24*f*. The signal 72*a* that remains on the loop 60*a* continues to travel around the loop 60*a* in a counter-clockwise direction.

If the parasitic loop 60*a* was not provided, the crosstalk that would be present on, for example, IDC 24*f* would include the sum of the crosstalk (both inductive and capacitive) induced from IDC 24*e* and IDC 24*a* onto IDC 24*f*. If the spacings and/or orientations of the IDCs result in IDC 24*a* and IDC 24*e* inducing different amounts of crosstalk onto IDC 24*f*, then there will not be full cancellation, and the remaining uncancelled crosstalk will appear as interference (noise) to the information signal present on IDC 24*f*. The crosstalk induced from IDCs 24*a* and 24*e* onto IDC 24*f* may comprise both NEXT and FEXT. As is known to persons of skill in the art, NEXT is equal to the sum of the differential capacitive and inductive coupling between IDCs 24*a* and 24*e* onto IDC 24*f*, while FEXT is equal to the difference of the differential capacitive and inductive coupling between IDCs 24*a* and 24*e* onto IDC 24*f*.

The inductive loop 60*a* changes this equation in two ways. First, the presence of the loop 60*a* may reduce the amount of crosstalk that flows directly from IDCs 24*a* and 24*e* onto IDC 24*f*. Second, as discussed above, the signals 72*e*, 72*a* that are induced onto the parasitic conductive loop 60*a* induce currents 73*e* and 74*a* on IDC 24*f*. In order to reduce and/or minimize the total uncancelled crosstalk induced on IDC 24*f* from IDCs 24*a*, 24*e*, the dimensions of the components (e.g., the IDCs, the parasitic conductive loop and the wires in the slots) and their physical arrangement with respect to each other may be designed so that the sum of the crosstalk signals induced on IDC 24*f* is small. The amount of inductive versus capacitive crosstalk may also be adjusted using the parasitic conductive loop to optimize both the NEXT and FEXT equations. The connecting block may similarly be designed to reduce and/or minimize the crosstalk induced on IDC 24*b* from IDCs 24*a*, 24*e*, as well as the crosstalk from IDCs 24*b* and 24*f* onto each of IDCs 24*a* and 24*e*.

Figure 9:
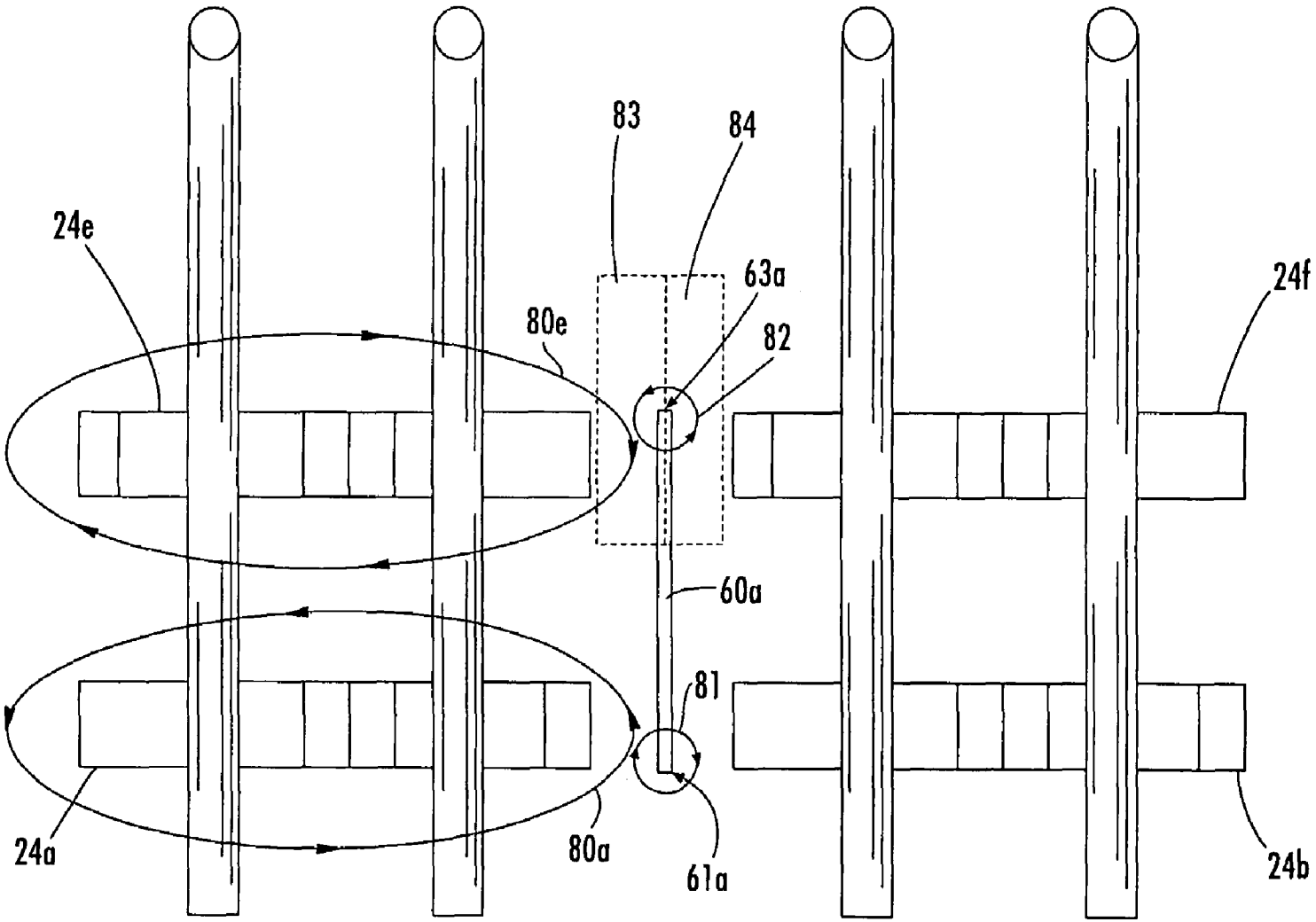
FIG. 9 is a cross-sectional view taken along the line I-I in FIG. 8.

The manner in which the parasitic inductive loop 60*a* may facilitate canceling crosstalk can also be understood by examining the electromagnetic fields that are generated both in the IDCs 24*e*, 24*a* and in the parasitic loop 60*a*. In particular, FIG. 9 is a cross-sectional view of FIG. 8 taken along the line I-I. As discussed above with respect to FIG. 8, in the present example it is assumed that the signal traveling through IDC 24*e* is traveling into the page in FIG. 9. Consequently, the magnetic fields 80*e* generated by the current flowing through IDC 24*e* extend in a clockwise direction. Similarly, as the signal flowing through IDC 24*a* travels out of the page in FIG. 9, the signal generates magnetic fields 80*a* that extend in a counter-clockwise direction. As is also discussed above with respect to FIG. 8, currents 72*a* and 72*e* (not shown in FIG. 9) are induced on the parasitic conductive loop 60*a* by IDCs 24*a* and 24*e*, respectively. Both currents flow in the same direction. On the right loop portion 61*a*, the currents 72*a*, 72*e* flow toward the top loop portion 62*a* (i.e., into the page in FIG. 9), and thus the corresponding magnetic field 81 extends in a clockwise direction. Similarly, on the left loop portion 63*a*, the currents 72*a*, 72*e* flow toward the bottom loop portion 64*a* (i.e., out of the page in FIG. 9), and thus the corresponding magnetic field 82 extends in a counter-clockwise direction.

Focusing now on the magnetic fields 80*e* and 82 in FIG. 9, it can be seen that in the region 83 immediately to the right of IDC 24*e* and to the left of the parasitic conductive loop 60*a*, the magnetic fields 80*e* and 82 both point downward, and hence are additive. However, in the region 84 that is immediately to the left of region 83 (i.e., on the far side of the loop), the magnetic field 82 points upward, and hence is opposed to the downward pointing magnetic field 80*e*. As a result, the fields 80*e* and 82 tend to cancel each other in the region 84, thereby reducing and/or minimizing the differential to differential crosstalk signal that the IDCs 24*a*, 24*e* of pair I impart on IDC 24*f*. A similar analysis shows that magnetic fields 80*a* and 81 tend to cancel each other in the region to the right of parasitic conductive loop 60*a*, thereby likewise reducing and/or minimizing the differential to differential crosstalk signal that the IDCs 24*a*, 24*e* of pair 1 impart on IDC 24*b*.

While the above example illustrates a connecting block 22 that incorporates IDCs 24*a*-24*h* that include jogs, it will be appreciated that the parasitic conductive loops of the present invention may also be used with conventional straight double-slotted IDCs. In such embodiments, planar parasitic conductive loops similar to the loop 60*a* discussed above may be used or, alternatively, three-dimensional parasitic conductive loops could be used such as, for example, parasitic conductive loops that include a jog. It will further be appreciated that the parasitic conductive loop need not be positioned between the IDCs, but instead may be positioned in other adjacent locations where the loop is capable of receiving an induced current from one or more disturbing conductors and can then use that induced current to generate a magnetic field in a second location that may facilitate reducing crosstalk within the connector.

Likewise, in certain embodiments of the present invention, parasitic rings 60*a*-60*d* need not be provided between each IDC pair. For example, it has been found that significant improvement in performance may be obtained by simply providing a parasitic ring 60 between each adjacent connecting block 22 (but otherwise not providing a parasitic ring between the four IDC pairs within each connecting block 22). Such a parasitic ring 60 could be mounted at one end of each connecting block 22, or could alternatively comprise a separate component that is mounted between adjacent connecting blocks 22.

It will also be appreciated that the concepts discussed above are equally applicable to other types of communications connectors. For example, a number of cross-connect systems are known in the art that are not compatible with 110-style cross-connect wiring systems. The parasitic conductive loops according to embodiments of the present invention can likewise be applied in these systems.

It will also be appreciated that both IDCs of an IDC pair need not induce significant amounts of current on the parasitic conductive loop. By way of example, in the embodiment discussed with respect to FIGS. 2-9 above, the IDCs 24*a* and 24*e* induce signals on the parasitic conductive loop that travel in the same direction around the loop (i.e., are additive). Crosstalk reduction may also be achieved, however, with connectors that are designed so that more current is induced onto the loop from one of IDCs 24*a*, 24*e* while little or no current is induced onto the loop from the other of IDCs 24*a*, 24*e*. Thus, while the exemplary embodiment depicted above is symmetrical in that both IDCs of the IDC pair induce currents on the parasitic conductive loop, it will be understood that this is not a necessary condition.

It will also be appreciated that, as with any crosstalk reduction systems, the size, shape, orientation, positioning, etc. of the conductive elements that are part of, or react with, the crosstalk reduction system must be selected to provide an appropriate level of crosstalk cancellation. Here, such parameters include at least the shape of the parasitic conductive loop(s) and all size parameters associated with such loops (e.g., thickness, dimensions, etc.), the shape sizes of the conductive elements (e.g., contacts, wires, etc.) that receive energy from and/or induce energy onto the parasitic conductive loop, the distances between conductive elements, and the orientation of the parasitic loop and each such conductive element with respect to each other. Additionally, capacitive coupling may occur between the wires that are inserted into the slots 31, 33 of each IDC 24*a*-24*h* and an adjacent parasitic conductive loop and/or the IDCs of an adjacent pair. Accordingly, the length of these wires and the relative position of the wires with respect to the parasitic conductive loop(s) and/or adjacent IDCs may be taken into account when tuning the design. Furthermore, while the description above has focused on the inductive coupling effects between the IDCs 24*a*-24*h* and the parasitic conductive loops 60*a*-60*d*, it will be appreciated that capacitive coupling also will occur between the IDCs and the parasitic conductive loops. This capacitive coupling may also need to be taken into account in the design to achieve a desired level of crosstalk reduction. In the embodiment of FIGS. 2-9 above, the coupling between the IDCs 24*a*-24*h* and their corresponding parasitic conductive loops 60*a*-60*d* will primarily comprise inductive coupling. However, in other designs, capacitive coupling effects could be more pronounced.

It will also be appreciated that a parasitic conductive loop may be created that is not a closed path. In particular, a loop may be created that included one or more very short breaks in the loop, with large capacitors provided that effectively allow current to span these gaps.

Figure 10:
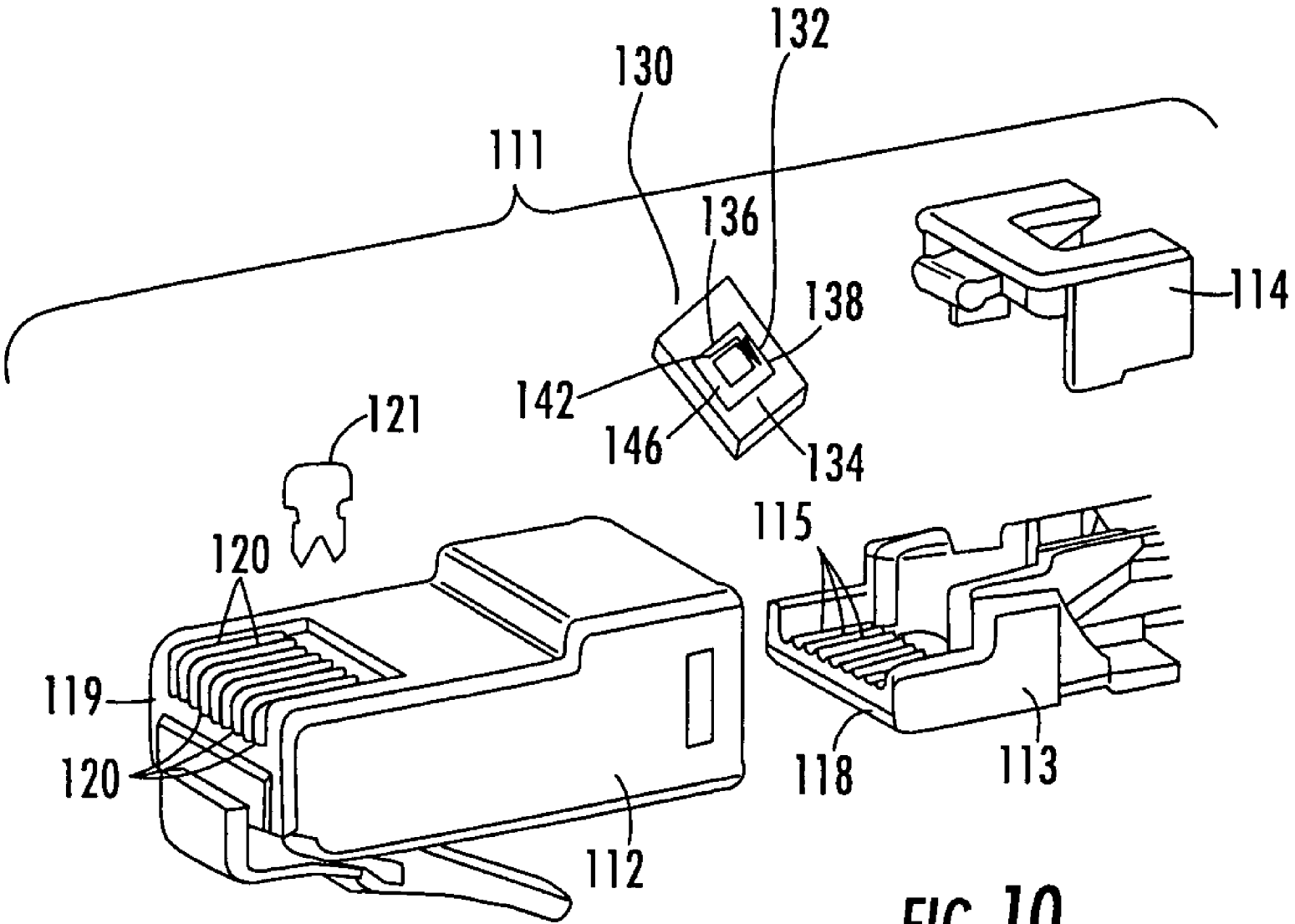
FIG. 10 is an exploded perspective view of a modular plug that includes a parasitic conductive loop according to embodiments of the present invention.

Pursuant to further embodiments of the present invention, modular plugs are provided that include parasitic conductive loops. FIG. 10 is an exploded perspective view of a modular plug 111 that includes such a parasitic conductive loop. As shown in FIG. 10, the modular plug 111 includes an outer housing member 112 having a hollow interior for housing a wire organizing sled 113. Housing 112 and sled 113 may be made of suitable dielectric (e.g., plastic) material. A cap or cover member 114 is configured to fit over and latch to the sled 113. The connector end 118 of sled 113 has a plurality of parallel grooves 115 therein which are adapted to hold the several wires from a cable (not shown) in parallel relationship in a planar array. Housing 112 has, at its connector end 119, a conductor alignment region having a plurality (e.g., eight) slots 120 into which blade contact member 121 are insertable. Contact members 121 have sharp points for piercing the insulation of the wires lying in grooves 115 for making electrical contact therewith. Blades 121, in turn, are positioned in the slots 120 for making electrical contact with jack springs in the jack (not shown) for receiving the plug 111.

Certain industry standards (e.g., the TIA/EIA-568-B.2-1 standard approved Jun. 20, 2002 by the Telecommunications Industry Association) specify that modular plugs include a total of eight wires that are configured to transmit four differential signals (i.e., four differential pairs). Pursuant to these standards, at the mating point between the modular plug and a modular jack, the wires of the first differential pair are placed in the two middle slots 120 (slots 4 and 5), the wires of the second differential pair are placed in the two leftmost slots 120 (slots 1 and 2), the wires of the fourth differential pair are placed in the two rightmost slots 120 (slots 7 and 8), and the wires of the third differential pair are placed in the remaining two slots 120 (slots 3 and 6). Thus, in at least the connection region where the contacts 121 of the modular plug 111 mate with the contacts of a corresponding modular jack (not shown in FIG. 10), the wires of the differential pairs are not equidistant from the wires of the other differential pairs. This may lead to undesired crosstalk, including, for example, differential to common mode crosstalk induced from the wires of pair 3 onto the wires of pairs 2 and 4.

In order to reduce such differential to common mode crosstalk, a printed circuit board 130 may be mounted in sled 113. As shown in FIG. 10, a parasitic conductive loop 132 is provided on the printed circuit board 130. The printed circuit board 130 fits over the wires (not shown) that lie in the grooves 115. In the embodiment of the present invention depicted in FIG. 10, the parasitic conductive loop 132 is a rectangular loop that includes a right portion 134, a left portion 136, a back portion 138 and a front portion 140. The parasitic conductive loop 132 may be used, for example, to inductively couple signal energy from one of the wires of differential pair 3 (e.g., wire 3) to be closer to the wires of pair 4 (wires 7 and 8). In particular, the printed circuit board 130 may be positioned so the left portion 136 of parasitic conductive loop 132 lies generally over wire 3, while right portion 134 of loop 132 lies generally over wire 6. The signal traveling through wire 3 will induce a signal 142 that flows in the opposite direction on the left portion 136 of parasitic conductive loop 132. Assuming, for the sake of example, that a signal flowing through wire 3 flows in the direction of the blades of the modular plug 111, the signal 142 will flow toward the back portion 138 of the loop 132, and then will flow through the right portion 134 of the loop towards the front portion 140 of the loop. In this manner, a signal having the same polarity as the signal in wire 3 may be provided adjacent wires 7 and 8, which may help reduce/cancel signal energy that is coupled from wire 6 onto wires 7 and 8. The parasitic loop 132 will also advantageously couple signal energy from wire 6 into the vicinity of wires 1 and 2, thereby reducing the differential to common mode crosstalk induced from pair 3 onto pair 2. It will be appreciated that the parasitic loop 132 need not be implemented on a printed circuit board, but could, for example, instead by a conductive ring that is encased in the dielectric of the plug housing 112.

Pursuant to further embodiments of the present invention, parasitic conductive loops may also be implemented in modular jacks. By way of example, a printed circuit board containing a parasitic conductive loop could be positioned adjacent the lead frame of a modular jack similar to how the parasitic ring 132 is positioned adjacent the contacts of the modular plug 111 in FIG. 10 in order to provide inductive crosstalk compensation.

Pursuant to specific embodiments of the present invention, wire connection systems are provided that include a mounting substrate, first and second pairs of wire connection terminals that are mounted in the mounting substrate, and a parasitic conductive loop mounted adjacent a first wire connection terminal of the first pair of wire connection terminals. Such wire connection systems include, for example, a wire connection block that has first and second pairs of IDCs mounted in the wire connection housing.

Pursuant to further embodiments of the present invention, crosstalk reduction circuits are provided for communications connectors. The crosstalk reduction circuit may be implemented as a parasitic conductive loop that is configured to receive a current induced from a first magnetic field that is generated by a first signal that is transmitted on a first conductor of the connector. The current so induced on the parasitic conductive loop generates a third magnetic field that at least partially cancels out a second magnetic field that is generated by a second signal that is transmitted on a second conductor of the connector.

Pursuant to additional embodiments of the present invention, communications connectors are provided that include a parasitic coupling element, a first conductor adjacent a first portion of the parasitic coupling element and a second conductor adjacent a second portion of the parasitic coupling element. In these connectors, the parasitic coupling element is configured to couple a compensating crosstalk signal that contains energy from a signal transmitted on the first conductor to the second conductor. The coupled compensating crosstalk signal is induced on the second conductor in a direction opposite the direction of the signal from which the crosstalk signal was generated.

Pursuant to yet further embodiments of the present invention, communications connectors are provided that include a first pair of contacts that are configured to receive a first differential signal, a second pair of contacts that are configured to receive a second differential signal, and a parasitic coupling element positioned between the first and second pairs of contacts. The parasitic coupling element receives first and second induced signals that have the same polarity from the respective contacts of the first pair of contacts.

Pursuant to yet additional embodiments of the present invention, methods for reducing a differential crosstalk signal induced from a first pair of conductors onto a third conductor of a communications connector are provided. Pursuant to these methods, a crosstalk signal is induced from a signal flowing through one of the conductors of the first pair of conductors onto a first portion of a parasitic conductive loop so as to generate a first magnetic field around a second portion of the parasitic conductive loop that at least partially cancels a second magnetic field generated by a signal flowing through the other conductor of the fist pair of conductors.

Pursuant to still further embodiments of the present invention, wire connection blocks are provided that include first and second wire connection terminals that define a first row of wire connection terminals and third and fourth wire connection terminals that define a second row of wire connection terminals that is generally parallel to the first row of wire connection terminals. The wire connection blocks further include an inductive coupling element that is positioned to inductively couple energy from a signal transmitted on the first wire connection terminal to the fourth wire connection terminal.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A wire connection system, comprising:

a mounting substrate;

a first pair of wire connection terminals mounted in the mounting substrate;

a second pair of wire connection terminals mounted in the mounting substrate; and a parasitic conductive loop mounted adjacent at least a first wire connection terminal of the first pair of wire connection terminals.

2. The wire connection system of claim 1, wherein a first portion of the parasitic conductive loop is positioned to receive an induced signal from at least the first wire connection terminal of the first pair of wire connection terminals, and wherein a second portion of the parasitic conductive loop is positioned so that the received induced signal generates a magnetic field adjacent at least one of the wire connection terminals of the second pair of wire connection terminals.

3. The wire connection system of claim 1, wherein the parasitic conductive loop is mounted between the first pair and the second pair of wire connection terminals.

4. The wire connection system of claim 1, wherein the wire connection terminals comprise insulation displacement contacts (IDCs).

5. The wire connection system of claim 4, wherein each of the IDCs includes slots for receiving conductors at opposite upper and lower ends thereof, the IDCs being mounted in the mounting substrate in at least two rows, wherein the slots of each IDC are generally parallel and non-collinear.

6. The wire connection system of claim 1, wherein the parasitic conductive loop is configured to receive a first induced signal from the first wire connection terminal of the first pair of wire connection terminals that travels around the loop in a first direction, and to receive a second induced signal from a second wire connection terminal of the first pair of wire connection terminals that travels around the loop in the first direction.

7. The wire connection system of claim 1, wherein the first pair of wire connection terminals comprises a first insulation displacement contact (IDC) and a second IDC, wherein the second pair of wire connection terminals comprises a third IDC and a fourth IDC, wherein the first and third IDCs are part of a first row of IDCs and the second and fourth IDCs are part of a second row of IDCs, and wherein the parasitic conductive loop is configured to couple energy from a signal carried on the first IDC to the fourth IDC.

8. The wire connection system of claim 7, wherein the parasitic conductive loop is further configured to couple energy from a signal carried on the second IDC to the third IDC.

9. The wire connection system of claim 1, wherein the wire connection system comprises a 110-style wire connection block.

10. The wire connection system of claim 1, wherein a first portion of the parasitic conductive loop is sized, shaped and positioned with respect to the first wire connection terminal of the first pair of wire connection terminals in order to induce a first crosstalk signal on the parasitic conductive loop from a signal carried by the first wire connection terminal, and wherein a second portion of the parasitic conductive loop is sized, shaped and positioned with respect to one of the wire connection terminals of the second pair of wire connection terminals in order to induce a second crosstalk signal onto the one of the wire connection terminals of the second pair of wire connection terminals from the first crosstalk signal.

11. The wire connection system of claim 1, wherein the parasitic conductive loop is configured to receive a first induced signal from at least the first wire connection terminal of the first pair of wire connection terminals and to induce a compensating crosstalk signal on both wire connection terminals of the second pair of wire connection terminals.

12. The wire connection system of claim 1, wherein the first pair of wire connection terminals are part of a first connecting block, and wherein the second pair of wire connection terminals are part of a second wire connection block.

13. The wire connection system of claim 1, wherein the first and second pairs of wire connection terminals comprise adjacent pairs of wire connection terminals in a first connecting block.

14. The wire connection system of claim 2, wherein the magnetic field at least partially cancels a second magnetic field generated by a second wire connection terminal of the first pair of wire connection terminals.

15. A crosstalk reduction circuit for a communications connector that includes a first conductor that carries a first signal and a second conductor that carries a second signal, the crosstalk reduction circuit comprising:

a parasitic conductive loop that is configured to receive a current induced from a first magnetic field generated by the first signal, wherein the current induced on the parasitic conductive loop generates a third magnetic field that at least partially cancels out a second magnetic field that is generated by the second signal.

16. The crosstalk reduction circuit of claim 15, wherein the first and second signals comprise equal but opposite signals.

17. The crosstalk reduction circuit of claim 15, wherein a first portion of the parasitic conductive loop is adjacent the first conductor and wherein a second portion of the parasitic conductive loop is adjacent the second conductor, and wherein a portion of a third magnetic field adjacent the first portion of the parasitic conductive loop has a first direction and a portion of the third magnetic field adjacent the second portion of the parasitic conductive loop has a second direction that is substantially opposite the first direction.

18. The crosstalk reduction circuit of claim 15, wherein the first conductor comprises a first conductor of a pair of conductors of a modular plug, and wherein the second conductor comprises the second conductor of the pair of conductors, and wherein the first and second signals comprise equal magnitude but opposite polarity signals.

19. The crosstalk reduction circuit of claim 18, wherein the modular plug includes first, second, third, fourth, fifth, sixth, seventh and eighth contacts that are in an adjacent and side-by-side relationship in a contact area of the modular plug, wherein the fourth and fifth contacts comprise a first contact pair for carrying a first differential signal, the first and second contacts comprise a second contact pair for carrying a second differential signal, the third and sixth contacts comprise a third contact pair for carrying a third differential signal, the seventh and eighth contacts comprise a fourth contact pair for carrying a fourth differential signal, and wherein the first conductor is electrically connected to one of the contacts of the third contact pair and wherein the second conductor is electrically connected to the other contact of the third contact pair.

20. The crosstalk reduction circuit of claim 15, wherein the first conductor comprises a first insulation displacement contact (IDC) and wherein the second conductor comprises a second IDC.

21. The crosstalk reduction circuit of claim 20, wherein the first IDC has a first conductor receiving slot and a second conductor receiving slot, wherein the first and second conductor receiving slots are arranged to be in the same plane but non-collinear.

22. The crosstalk reduction circuit of claim 15, wherein the third magnetic field at least partially cancels the second magnetic field in the vicinity of a third conductor of the communications connector.

23. A communications connector, comprising:

a conductive parasitic coupling element;

a first conductor adjacent a first portion of the conductive parasitic coupling element; and a second conductor adjacent a second portion of the conductive parasitic coupling element;

wherein the conductive parasitic coupling element is configured to receive a signal that is induced from a first signal that is transmitted on the first conductor, transmit the received signal over at least a portion of the conductive parasitic element, and then couple the received signal to the second conductor, wherein the coupled signal is induced on the second conductor in a direction opposite the direction of the first signal.

24. The communications connector of claim 23, wherein the conductive parasitic coupling element comprises a loop, and wherein the first portion of the parasitic coupling element is on a first part of the loop and the second portion of the parasitic coupling element is on a second portion of the loop that is generally opposite the first part of the loop.

25. The communications connector of claim 23, wherein the first and second conductors each comprise an insulation displacement contact (IDC) that has an upper end having a first slot and a lower end having a second slot that is parallel and non-collinear with respect to the first slot.

26. A communications connector, comprising:

a first pair of contacts comprising a First contact and a second contact that are configured to receive a first differential signal;

a second pair of contacts comprising a third contact and a fourth contact that are configured to receive a second differential signal; and a conductive parasitic coupling element positioned between the first pair of contacts and the second pair of contacts, wherein the conductive parasitic coupling element is configured to receive a first induced signal from the first contact that has a first polarity and is configured to receive a second induced signal from the second contact that has the first polarity.

27. The communications connector of claim 26, wherein the conductive parasitic coupling element comprises a parasitic conductive loop.

28. The communications connector of claim 27, wherein the parasitic conductive loop is configured to induce a third signal on the third contact from the first and second induced signals.

29. A method for reducing a differential crosstalk signal induced from a first pair of conductors that comprises a first conductor and a second conductor onto a third conductor of a communications connector, the method comprising:

inducing a crosstalk signal from a signal flowing through the first conductor onto a first portion of a parasitic conductive loop so as to generate a first magnetic field around a second portion of the parasitic conductive loop that at least partially cancels a second magnetic field generated by a signal flowing through the second conductor.

30. The method of claim 29, wherein the first and second magnetic fields at least partially cancel each other adjacent the third conductor.

31. A wire connection block, comprising:

a first wire connection terminal and a second wire connection terminal that define a first row of wire connection terminals;

a third wire connection terminal and a fourth wire connection terminal that define a second row of wire connection terminals that is generally parallel to the first row of wire connection terminals;

wherein each of the first through fourth wire connection terminals has an upper end having a first slot and a lower end having a second slot that is parallel and non-collinear with respect to the first slot; and an inductive coupling element positioned to inductively couple energy from a signal transmitted on the first wire connection terminal to the fourth wire connection terminal.

32. The wire connection block of claim 31, wherein the inductive coupling element comprises a parasitic conductive loop.

33. The wire connection block of claim 31, wherein the inductive coupling element comprises a signal carrying protrusion on the first wire connection terminal.

34. The wire connection system of claim 1, wherein the mounting substrate is comprised of a first mounting substrate and a second mounting substrate, wherein the first pair of wire connection terminals are mounted in the first mounting substrate, and wherein the second pair of wire connection terminals are mounted in the second mounting substrate.

* * * * *